US006898836B2

(12) United States Patent
Barber et al.

(10) Patent No.: US 6,898,836 B2
(45) Date of Patent: May 31, 2005

(54) METHOD OF SECURING A SLEEVE IN A TUBULAR MEMBER

(75) Inventors: Mark W. Barber, St. Thomas (CA); John Dicesare, London (CA)

(73) Assignee: Magna International Inc., Auroro (CA)

( * ) Notice: Subject to any disclaimer, the term of this patent is extended or adjusted under 35 U.S.C. 154(b) by 0 days.

(21) Appl. No.: 10/203,902

(22) PCT Filed: Feb. 13, 2001

(86) PCT No.: PCT/CA01/00212

§ 371 (c)(1),
(2), (4) Date: Dec. 23, 2002

(87) PCT Pub. No.: WO01/60544

PCT Pub. Date: Aug. 23, 2001

(65) Prior Publication Data

US 2003/0126730 A1 Jul. 10, 2003

Related U.S. Application Data

(60) Provisional application No. 60/183,350, filed on Feb. 18, 2000.

(51) Int. Cl.[7] ..... B21D 39/00; B21D 22/00

(52) U.S. Cl. ..... 29/510; 29/515; 29/509; 72/353.2

(58) Field of Search ..... 29/421.1, 510, 29/516, 514, 515, 890.038, 890.04, 508, 509; 72/353.2, 355.4

(56) References Cited

U.S. PATENT DOCUMENTS

| | | | | |
|---|---|---|---|---|
| 2,228,740 A | | 1/1941 | Wagner et al. | |
| 3,344,370 A | | 9/1967 | Sewell | |
| 3,412,825 A | | 11/1968 | Hall | |
| 3,742,673 A | | 7/1973 | Jennings et al. | |
| 5,491,883 A | * | 2/1996 | Marlinga | 29/421.1 |
| 5,725,247 A | | 3/1998 | Nilsson et al. | |
| 5,868,457 A | | 2/1999 | Kitagawa | |
| 5,913,565 A | | 6/1999 | Watanabe | |
| 6,010,155 A | | 1/2000 | Rinehart | |
| 6,070,445 A | * | 6/2000 | Holierhoek | 72/61 |
| 6,138,358 A | * | 10/2000 | Marando | 29/897.2 |
| 6,186,696 B1 | | 2/2001 | Valin | |
| 6,216,509 B1 | * | 4/2001 | Lotspaih et al. | 72/61 |
| 6,324,758 B1 | * | 12/2001 | Huang et al. | 29/890 |
| 6,408,515 B1 | * | 6/2002 | Durand | 29/897.2 |
| 2003/0159289 A1 | * | 8/2003 | Van Giezen | 29/897.2 |

FOREIGN PATENT DOCUMENTS

| | | | |
|---|---|---|---|
| DE | 195 26 398 | | 1/1996 |
| EP | 0 620 056 | | 6/1997 |
| WO | WO98/29207 | | 7/1998 |
| WO | WO 98/29207 | * | 7/1998 |
| WO | WO01/60544 | | 8/2001 |

* cited by examiner

*Primary Examiner*—Marc Jimenez
(74) *Attorney, Agent, or Firm*—Pillsbury Winthrop LLP

(57) ABSTRACT

A method for forming a hollow part (18) that allows the use of hydroforming in cases where the part interconnects between sections having extreme variations in cross-section. A complete hollow part (18) is formed by joining a hydroformed hollow section with hollow sections. A method for securing a fastener sleeve (102) insert in a pre-fabricated hollow part (100) is also provided. In this method, the hollow part (100) is deformed slightly to form flanges (108) that secure the insert (102) in the part. Once the insert (102) is secure in the hollow part, fasteners can be applied to the part without collapsing it.

14 Claims, 5 Drawing Sheets

METHOD OF SECURING A SLEEVE IN A TUBULAR MEMBER

This application is the National Phase of International Application PCT/CA01/00212 filed Feb. 13, 2001 which designated the U.S. This application is also based on U.S. Provisional Application Ser. No. 60/183,350, filed on Feb. 18, 2000, the entire contents of which are hereby incorporated herein by reference thereto.

FIELD OF THE INVENTION

This invention relates generally to the field of motor vehicle frames, and more specifically to the hydroforming of hollow parts for use in motor vehicle frames.

BACKGROUND OF THE INVENTION

Hollow parts for auto body construction, such as frame members or reinforcement beams, may ideally require a varying cross-sectional shape and/or perimeter along their length. Conventional hollow parts having varying cross-section may, for example, be stamped from two pieces of sheet metal, each piece forming two longitudinal halves of the completed tube. The two pieces are then welded together with two welded seams, each weld running the length of the part. This requires a relatively large amount of labor and welding to produce the finished hollow member, thus resulting in large processing expense.

One method for producing hollow parts with varying cross section is hydroforming. The process of hydroforming metal structural components is well known. See, for example, U.S. Pat. Nos. 4,567,743, 5,070,717, 5,107,693, 5,233,854, 5,239,852, 5,333,775, and 5,339,667, the disclosures of which are hereby incorporated by reference. In a conventional hydroforming process, a tubular metal blank member is placed into a die cavity of a hydroforming die. Opposite ends of the tube are sealed, and fluid is injected under pressure internally to the tubular blank so as to expand the blank outwardly into conformance with the interior surfaces defining the die cavity. In more recent improvements to the conventional hydroforming process, opposite ends of the tubular blank are forced longitudinally toward one another during outward expansion of the tube so as to replenish the wall thickness of the metal as it is expanded outwardly. An exemplary process for replenishing material by longitudinally compressing the blank is disclosed in U.S. Pat. Nos. 5,718,048, 5,855,394, 5,899,498, and commonly-assigned 5,979,201 and 6,014,879.

An advantage to hydroforming hollow parts is that high-strength parts having irregular cross-sectional configurations can be made easily and cost-effectively, in a manner which would be extremely difficult if not impossible to accomplish using stamping or roll-forming techniques.

For some applications where a hollow part requires extreme variations in cross-section, hydroforming becomes somewhat problematic in conventional hydroforming, the cross-section diameter of the uniform cross-sectioned blank (typically cylindrical in shape) is typically chosen to be somewhat less than the smallest dimension of the part to be formed. The blank is then expanded as determined by the size of the die cavity. Where portions of the tube blank are to be expanded to very large extents (e.g., greater than 30%), the wall thickness of the tube at such locations may become overly thin to the detriment of the part.

For certain applications wherein extended portions of the part can be provided with a generally constant cross-sectional shape (e.g., as would be produced by extrusion) there is no need to subject the entire part to a hydroforming process. In addition, it may be desirable to provide a hollow part that incorporates two or more uniformed cross section tubular members (e.g., formed by extrusion or roll forming), but of different cross-sectional shapes and/or dimensions from one another. To provide such a part is problematic, however, because of the need to connect tubes having dissimilar shapes and/or dimensions.

It is therefore an object of the present invention to overcome the difficulties noted above in a novel, cost-effective manner.

SUMMARY OF THE INVENTION

The present invention is a method for forming a hollow part. To achieve the forgoing object, a first hollow member is provided which has a first open end and a second open end, the first end having a predetermined structural dimension and shape. A second hollow member is provided which also has a first open end and a second open end, the first end having a predetermined structural dimension and shape. The first end of the first hollow member differs from the first end of the second hollow member in dimension or shape or both. A third hollow member is formed, such that it has a first open end with a structural dimension and shape generally the same as the structural dimension and shape of the first end of the first hollow member and it has a second open end with a structural dimension and shape generally the same as the structural dimension and shape of the first end of the second hollow member. The forming of the third hollow member includes placing it into a die cavity of a hydroforming die assembly and expanding it into conformity with surfaces defining the die cavity so as to provide a portion thereof which is to constitute the first end with generally the same structural dimension and shape as the first end of the first hollow member upon expansion. The die cavity is further shaped such that another portion of the third hollow member, which constitutes the second end, will have substantially the same structural dimension and shape as the first end of the second hollow member. The first end of the third hollow member is welded to the first end of the first hollow member and the second end of the third hollow member is welded to the first end of the second hollow member.

In a second aspect of the present invention, a method for securing a fastener connecting sleeve into a pre-fabricated hollow member is provided. The hollow member has first and second opposing walls that have first and second holes respectively formed therein, and the first and second holes are aligned with first and second ends of the connecting sleeve respectively. The method comprises inserting the connecting sleeve into the interior of the hollow member through one end of the hollow member so that the connecting sleeve has its first and second opposing open ends disposed adjacent to the first and second walls of the hollow member. The first wall is then deformed to form a first flange that surrounds the first hole and projects into the first open end of the connecting sleeve. Similarly, the second wall is deformed to form a second flange that surrounds the second hole and projects into the second open end of the connecting sleeve. The first flange and second flange thus secure the first and second open ends of the connecting sleeve in alignment with the first and second hole to permit a fastener to pass therethrough.

DETAILED DESCRIPTION OF THE PREFERRED EMBODIMENTS

Figure 1:
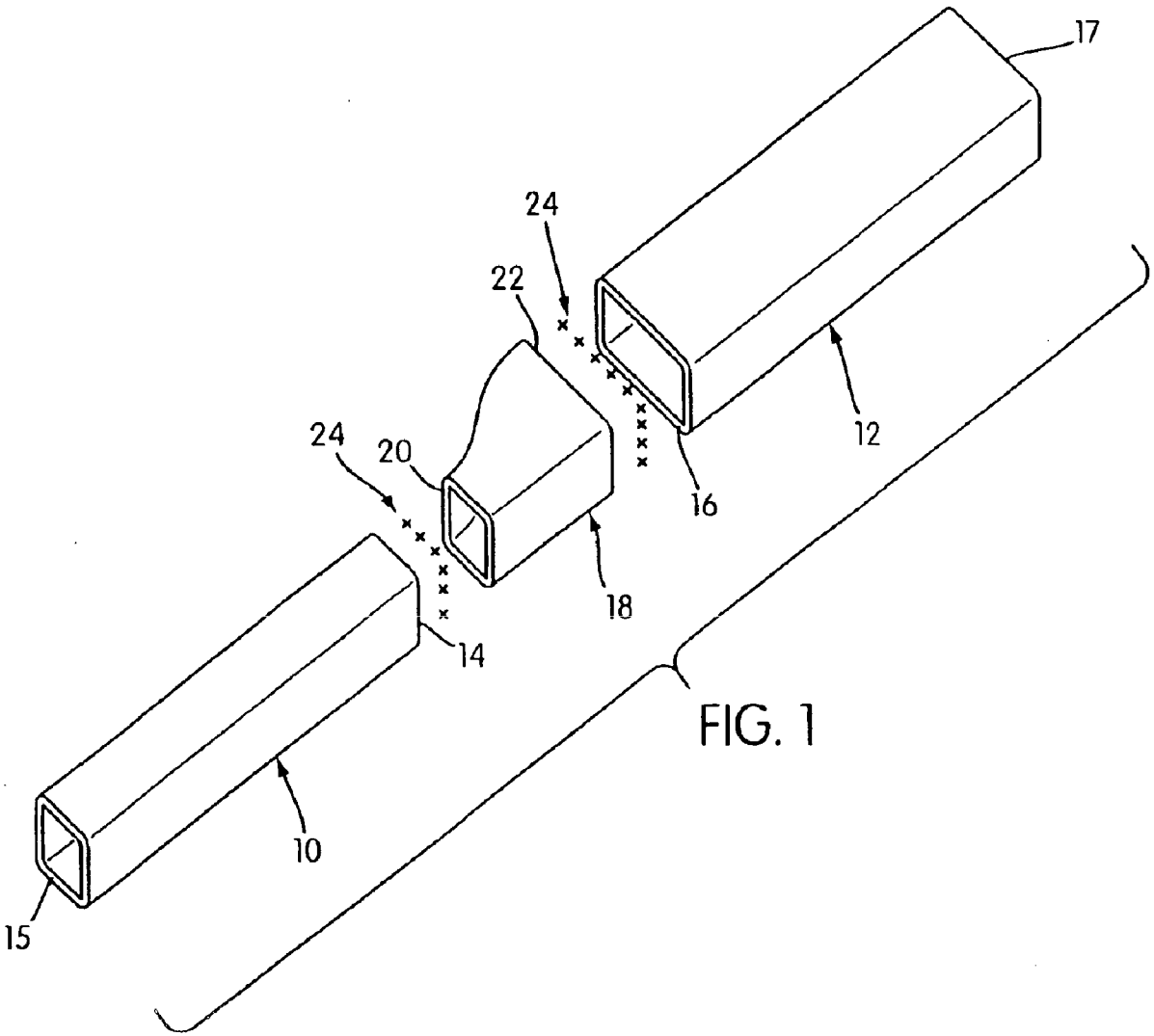
FIG. 1 is an exploded, isometric view of a hollow part formed in accordance with the present invention.

In a preferred embodiment of the present invention two hollow members 10, 12 are provided as shown in FIG. 1. The first of the two hollow members 10 has a first open end 14 with a predetermined structural dimension and shape and a second open end 15. The second of the two hollow members 12 also has a first open end 16 with a predetermined structural dimension and shape and a second open end 17. One or both of the dimension and shape of the first end 16 of the second hollow member 12 differ from that of the first end 14 of the first hollow member 10. The two hollow members 10, 12 may be of any metallic material and may be formed in any manner appropriate to the material and desired application, but most preferably extruded, and preferably made from aluminum. The members 10, 12 preferably have a multi-sided, non-cylindrical cross-section shape (e.g., triangular, quadrilateral, pentagonal).

In an alternate embodiment, each of the two hollow members 10, 12 may be hydroformed tubes.

To join the two hollow members 10, 12, a third hollow member 18 which acts as an adapter or transition member is formed which has a first open end 20 with generally the same structural dimension and shape as that of the first end 14 of the first hollow member 10, and which also has a second open end 22 with generally the same structural dimension and shape as that of the first end 16 of the second hollow member 12. Shown schematically in FIG. 1 are the weld lines 24 used to connect the third hollow member 18 to the first and second hollow members 10, 12.

Figure 2:
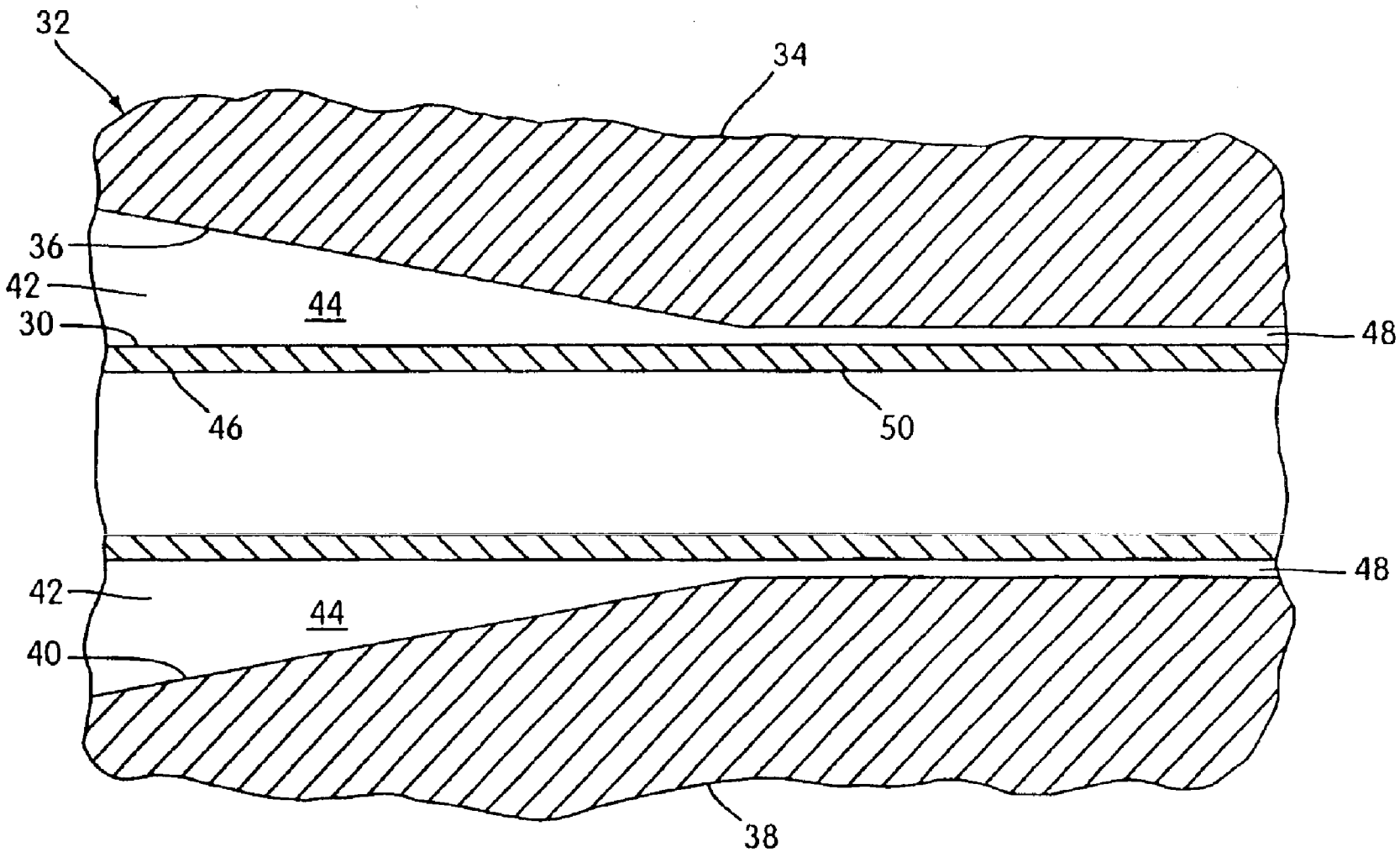
FIG. 2 is a sectional view of a tubular blank in a hydroforming cavity in accordance with the invention.
Figure 3:
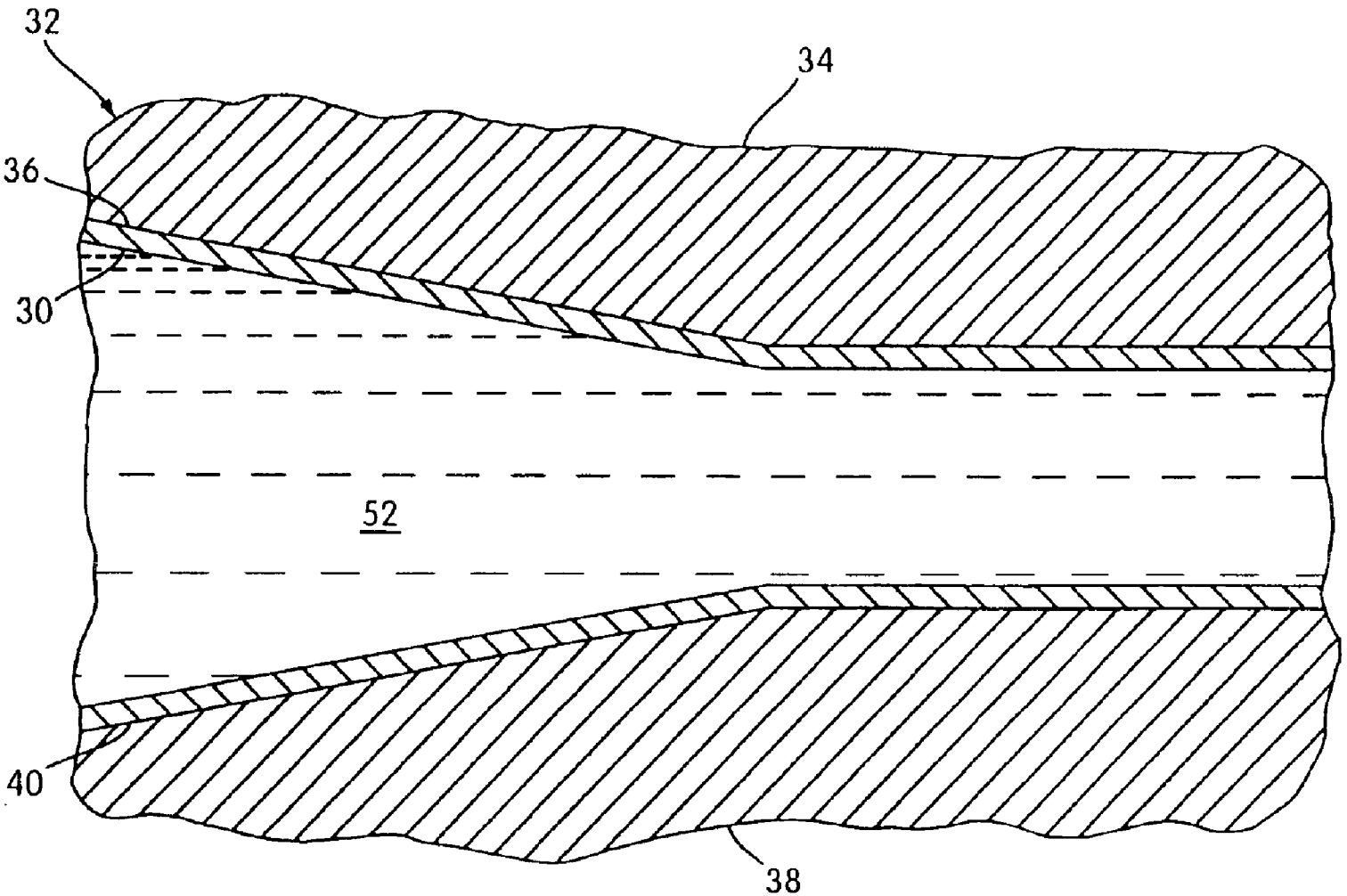
FIG. 3 is a sectional view of the hollow member having been expanded in the hydroforming cavity in accordance with the invention.

The adapter 18 is formed by hydroforming. More particularly, referring now to FIGS. 2 and 3, a tubular metal blank 30 is hydroformed into a component having differing transverse (cross-sectional) dimensions and/or shapes at the opposite ends 20, 22 thereof. As shown in FIG. 2, the blank 30 is placed into a hydroforming die 32 which has an upper portion 34 having an upper die surface 36 and a lower portion 38 having a lower die surface 40. When the upper and lower die portions 34, 38 are placed together, the upper die surface 36 and lower die surface 40 together define a die cavity 42. The die cavity 42 includes a first expanding portion 44 that is constructed and arranged to expand a first portion of the blank 46 to a first predetermined shape and dimension, and a second expanding portion 48 that is constructed and arranged to expand a second portion of the blank 50 to a second predetermined shape and dimension. At least one of the shape and dimension of the first portion is different from that of the second portion. After the blank 30 is placed between the upper and lower die portions 34, 38 and the upper and lower die portions 34 and 38 are placed together to define the die cavity 42. The ends of the blank are sealed by sealing rams as known in the art, as exemplified by the patents previously incorporated by reference. A high pressure hydroforming fluid 52 is introduced through one of the sealing members into the blank 30, causing it to expand into conformity with the surfaces 36, 40 of the die cavity as shown in FIG. 3.

Figure 4:
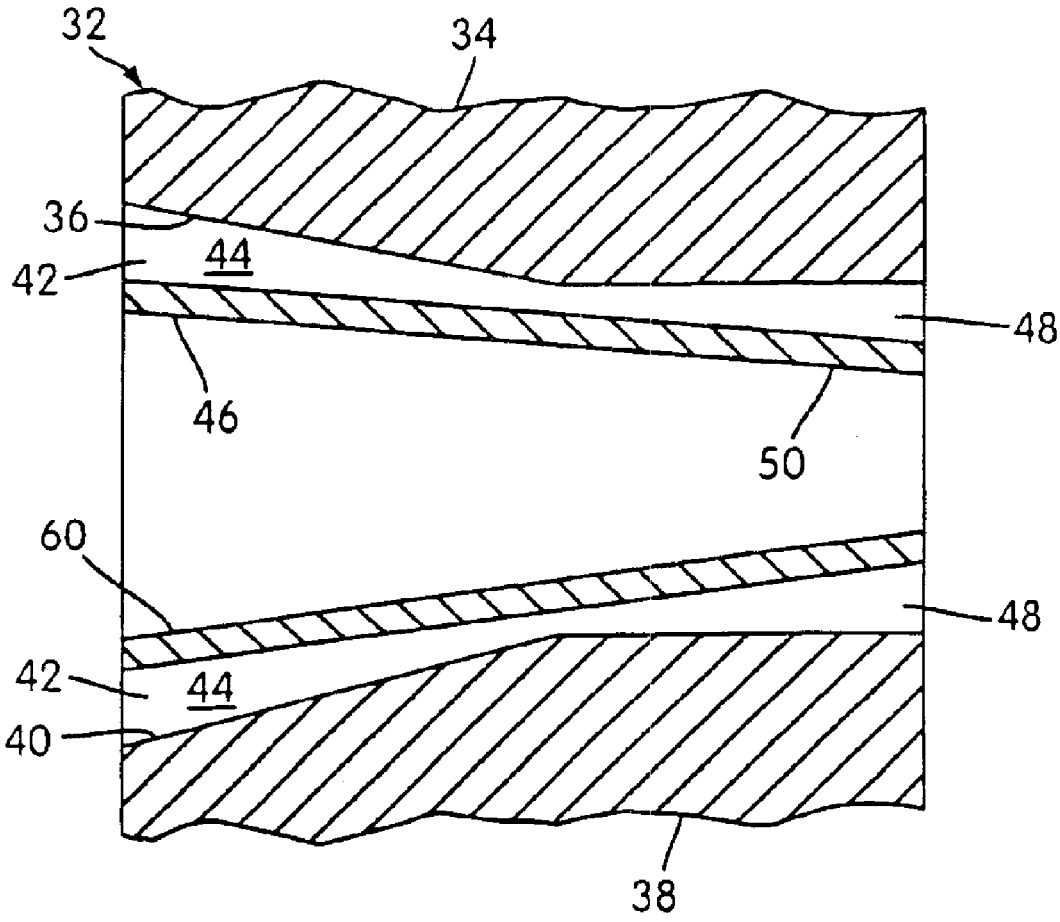
FIG. 4 is sectional view of a generally conical tubular blank in a hydroforming cavity in accordance with another embodiment of the invention.

In the case where the desired structural dimensions of the ends of the finished third hollow member are of significantly differing dimensions (one end having a much greater cross-sectional perimeter than the other), a conical tubular blank 60 may be used instead of the conventional cylindrical tubular blank (see FIG. 4). Preferably, the conical tubular blank 60 is formed by rolling sheet metal into a generally conical tubular configuration. Such a conical blank 60 helps to overcome potential problems with excessive thinning of the tube where it must expand to a greater degree to conform to the die cavity surfaces 36, 40. That is, each end of the blank has a perimeter that corresponds more closely with the associated portions of the die into which it is to be expanded.

The shape and size of opposing portions of the die cavity are constructed to have the dimension required for the hydroformed part to have opposite ends 20, 22 thereof align geometrically and dimensionally with the ends 14 and 16 of the extruded tubes to be mated (welded) therewith. In this regard, it should be noted that the present invention appreciates that after the hydroformed adapter is removed from the hydroforming die, it may be necessary to cut off end portions of the hydroformed part that have been deformed in order to mate with the opposing sealing rams. This cutting-off step is known in the hydroforming art, but is not always required. In the case where cutting is required, the portions of the hydroforming die cavity which are constructed to provide the adapter member 18 with the desired shape and dimension at said opposite end portions are spaced inwardly from the end portions of the blank, and are located (aligned with) at the areas at which the part pulled out of the hydroforming die are to be cut. These cut ends 20, 22 are then welded to the ends 14, 16, respectively.

Where the finished hollow part is to be secured to another structural component, it may be desirable to punch a hole in the part and pass a fastener, such as a bolt, therethrough. Where tubes are formed from two longitudinal stamped halves which are subsequently welded longitudinally, it is relatively simple to include additional processing steps to include reinforcing members in the finished tube because access to the interior of the tube is available prior to welding. In the case where the tube is integrally formed as a one-piece member, such as by hydroforming or extrusion, however, the process becomes more difficult.

Figure 5:
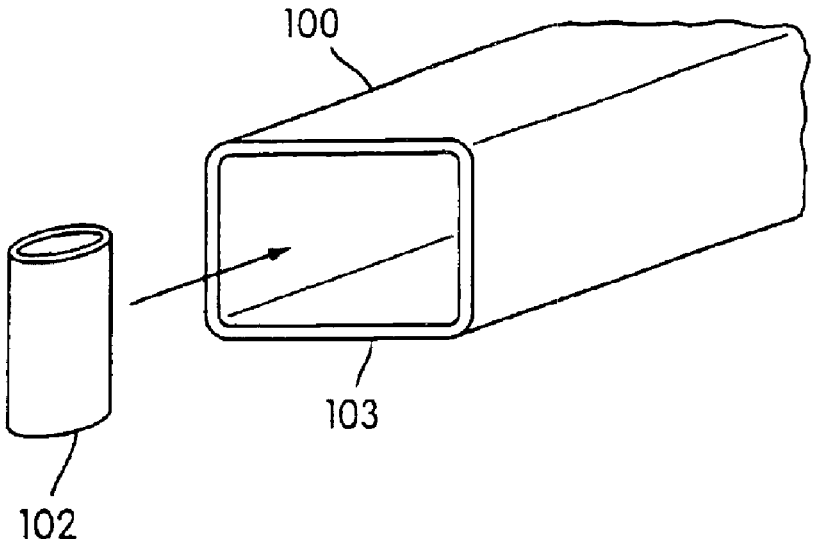
FIG. 5 is an isometric view of a reinforcing tube being inserted into a hollow member in accordance with another aspect of the invention.
Figure 6:
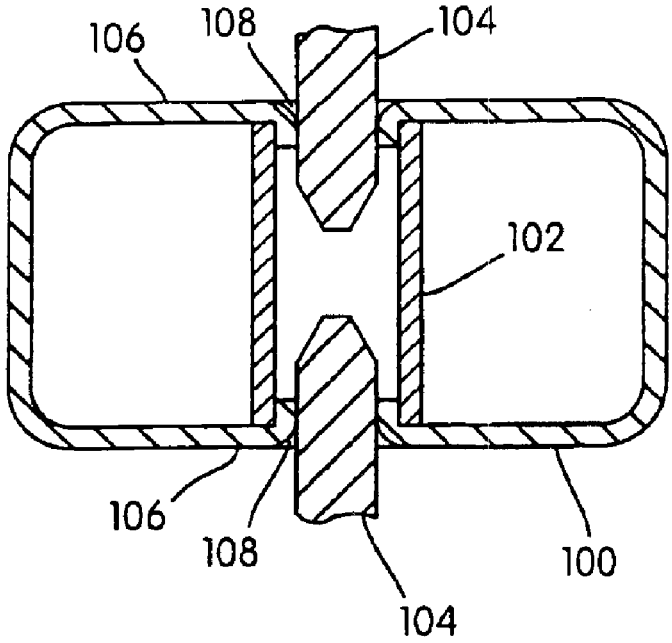
FIG. 6 is a sectional view of a hollow member and a reinforcing tube with flanging punches in accordance with the invention.

It is another object of the invention to provide an internal sleeve within an extruded and/or hydroformed tube to serve as reinforcement to the hollow part at such location. Specifically, to increase strength of the tube, a reinforcement sleeve 102 can be used to accept fasteners therethrough without risk of collapsing the tube. FIG. 6 shows a cross-section of a hollow member 100 with the reinforcing connecting sleeve 102 affixed therein. The connecting sleeve 102 is inserted into the hollow member 100 through an open end 103 thereof as shown in FIG. 5. To affix the sleeve 102, opposing flanging punches 104 are forced through opposite walls 106 of the hollow member, into open ends of the sleeve 102.

In a preferred embodiment, pre-punched holes are provided in the opposite walls 106, such holes having a smaller diameter than the diameter of the punches 104 and aligned with the open ends of sleeve 102. Thus, when the punches 104 are forced through such holes in the walls 106, the edges surrounding these holes are bent to form flanges 108 extending into the open ends of the sleeve 102. The pre-punched holes may, for example, be formed in a hydropiercing operation, in the instance where the tube 100 is a tube section formed by hydroforming.

In an alternate embodiment, no pre-punched hole is formed in the opposing tube walls 106, and the flanging punches 104 themselves form holes in opposite walls 106 of the hollow member. Material from the opposite walls 106 of the hollow member is deformed to form flanges 108. The flanges 108 are disposed around the circumference of the holes formed in the hollow member and extend into the opposite ends of the sleeve 102. In either embodiment, the flanges 108 fix the ends of the sleeve relative to the hollow member 100. Preferably, a computer numeric controlled hydraulic system is used to insert the sleeve 102 into the tube 100, to ensure that the punches 104 are aligned with the opened ends of the sleeve prior to the punching operation, and to force punches 104 inwardly. Alternately, a fixture can be used and the sleeve 102 inserted by hand. While the ends of the sleeve 102 can then be welded to the opposite tube walls 106 (e.g., by laser welding, projection welding, etc.), it is contemplated that the mechanical interlocking relationship of the flanges 108 within the sleeves 102 can be the sole means for securing the sleeve 102 to the tube 100.

It will be appreciated that the above descriptions are intended only to serve as examples, and that many other embodiments are possible within the the scope of the present invention.

What is claimed is:

1. A method of securing a fastener connecting sleeve into a pre-formed tubular member, the method comprising:

providing a pre-formed tubular member having opposing first and second walls and an open end;

providing a fastener connecting sleeve having first and second open ends;

inserting the connecting sleeve into an interior of the tubular member through the open end of the tubular member so that the opposing first and second open ends of the connecting sleeve are disposed adjacent to the first and second walls of the tubular member, respectively;

initially piercing the first wall, without the assistance of a pre-punched hole in the first wall, by a first deforming element to form a first hole in the first wall and to form a first flange surrounding the first hole, the first hole being sized by the first deforming element to a final dimension for receiving a fastener extending through the first hole, the first flange projecting into the first open end of the connecting sleeve; and initially piercing the second wall, without the assistance of a pre-punched hole in the second wall, by a second deforming element to form a second hole in the second wall and to form a second flange surrounding the second hole, the second hole being sized by the second deforming element to the final dimension for receiving the fastener extending through the second hole, the second flange projecting into the second open end of the connecting sleeve;

the first flange securing the first open end of the connecting sleeve in alignment with the first hole in the first wall and the second flange securing the second open end of the connecting sleeve in alignment with the second hole in the second wall to permit the fastener to pass through the first and second holes and through the connecting sleeve.

2. A method according to claim 1, wherein the deforming the first wall by the first deforming element occurs simultaneously with the deforming the second wall by the second deforming element.

3. A method according to claim 1, wherein the deforming the first wall by the first deforming element occurs with only one pass of the first deforming element and the deforming the second wall by the second deforming element occurs with only one pass of the second deforming element.

4. A method according to claim 1, further comprising:

passing a fastener through the tubular member by passing the fastener through the first hole, the connecting sleeve, and the second hole.

5. A method according to claim 1, wherein the deforming of the first wall to form the first hole occurs without removing a portion of the first wall.

6. A method according to claim 1, wherein the deforming of the first wall to form the first hole includes simultaneously piercing and deforming the first wall by the first deforming element.

7. A method of securing a fastener connecting sleeve into a pre-formed tubular member, the method comprising:

providing a pre-formed tubular member having opposing first and second walls and an open end;

providing a fastener connecting sleeve having first and second open ends;

inserting the connecting sleeve into an interior of the tubular member through the open end of the tubular member so that the opposing first and second open ends of the connecting sleeve are disposed adjacent to the first and second walls of the tubular member, respectively;

deforming the first wall by a first deforming element to form a first hole in the first wall and to form a first flange surrounding the first hole, the first flange projecting into the first open end of the connecting sleeve; and deforming the second wall by a second deforming element to form a second hole in the second wall and to form a second flange surrounding the second hole, the second flange projecting into the second open end of the connecting sleeve;

the first flange securing the first open end of the connecting sleeve in alignment with the first hole in the first wall and the second flange securing the second open end of the connecting sleeve in alignment with the second hole in the second wail to permit the fastener to pass through the first and second holes and through the connecting sleeve, wherein the deforming the first wall by the first deforming element occurs simultaneously with the deforming the second wall by the second deforming element.

8. A method according to claim 7, further comprising:

passing a fastener through the tubular member by passing the fastener through the first hole, the connecting sleeve, and the second hole.

9. A method according to claim 7, wherein the deforming of the first wall to form the first hole includes simultaneously piercing and deforming the first wall by the first deforming element.

10. A method of securing a fastener connecting sleeve into a pre-formed tubular member, the method comprising:

providing a pre-formed tubular member having opposing first and second walls and an open end;

providing a fastener connecting sleeve having first and second open ends;

inserting the connecting sleeve into an interior of the tubular member through the open end of the tubular member so that the opposing first and second open ends of the connecting sleeve are disposed adjacent to the first and second walls of the tubular member, respectively;

deforming the first wall by a first deforming element to form a first hole in the first wall and to form a first flange surrounding the first hole, the first flange projecting into the first open end of the connecting sleeve;

deforming the second wall by a second deforming element to form a second hole in the second wall and to form a second flange surrounding the second hole, the second flange projecting into the second open end of the connecting sleeve; and the first flange securing the first open end of the connecting sleeve in alignment with the first hole in the first wall and the second flange securing the second open end of the connecting sleeve in alignment with the second hole in the second wall to permit the fastener to pass through the first and second holes and through the connecting sleeve, wherein the deforming of the first wall to form the first hole occurs without removing a portion of the first wall.

11. A method according to claim 10, wherein the deforming the first wall by the first deforming element occurs simultaneously with the deforming the second wall by the second deforming element.

12. A method according to claim 10, further comprising:

passing a fastener through the tubular member by passing the fastener through the first hole, the connecting sleeve, and the second hole.

13. A method according to claim 10, wherein the deforming of the second wall to form the second hole occurs without removing a portion of the second wall.

14. A method according to claim 10, wherein the deforming of the first wall to form the first hole includes simultaneously piercing and deforming the first wall by the first deforming element.

* * * * *